US010701993B2

(12) United States Patent
Lim

(10) Patent No.: US 10,701,993 B2
(45) Date of Patent: Jul. 7, 2020

(54) INDUSTRIAL IMPACT SAFETY GLOVE

(71) Applicant: Ringers Technologies LLC, Houston, TX (US)

(72) Inventor: Hardy Lim, Houston, TX (US)

(73) Assignee: Ringers Technologies LLC, Houston, TX (US)

( * ) Notice: Subject to any disclaimer, the term of this patent is extended or adjusted under 35 U.S.C. 154(b) by 95 days.

(21) Appl. No.: 15/938,721

(22) Filed: Mar. 28, 2018

(65) Prior Publication Data

US 2019/0098945 A1 Apr. 4, 2019

Related U.S. Application Data

(63) Continuation of application No. 29/619,633, filed on Sep. 29, 2017, now abandoned, which is a continuation of application No. 29/619,648, filed on Sep. 29, 2017, now Pat. No. Des. 858,895.

(51) Int. Cl.
*A41D 19/015* (2006.01)
*A41D 13/08* (2006.01)

(52) U.S. Cl.
CPC . *A41D 19/01517* (2013.01); *A41D 19/01523* (2013.01); *A41D 19/01558* (2013.01); *A41D 13/084* (2013.01)

(58) Field of Classification Search
CPC ..... A41D 19/01523; A41D 19/01505; A41D 19/01547
See application file for complete search history.

(56) References Cited

U.S. PATENT DOCUMENTS

| | | | | |
|---|---|---|---|---|
| 2,686,316 | A | 8/1954 | Linn | |
| 4,000,524 | A | 1/1977 | Rinehart | |
| 4,272,849 | A | 6/1981 | Thurston et al. | |
| 4,454,611 | A | 6/1984 | Tschirch et al. | |
| 4,570,269 | A | 2/1986 | Berlese | |
| 4,766,612 | A | 8/1988 | Patton, Sr. | |
| 4,768,234 | A * | 9/1988 | Yamamoto ..... | A41D 19/01523 2/16 |
| 4,815,147 | A | 3/1989 | Gazzano et al. | |
| 5,016,286 | A | 5/1991 | Henriksen | |
| D328,369 | S | 7/1992 | Hong | |
| 5,349,705 | A | 9/1994 | Ragan | |
| 5,488,739 | A | 2/1996 | Cardinal | |

(Continued)

FOREIGN PATENT DOCUMENTS

| | | |
|---|---|---|
| CN | 2909876 | 6/2007 |
| CN | 201821981 | 5/2011 |

(Continued)

*Primary Examiner* — Tajash D Patel
(74) *Attorney, Agent, or Firm* — Moser Taboada

(57) ABSTRACT

A safety glove for protecting the hand of a worker is provided, configured to protect the hand of the worker while still providing flexibility and dexterity to the user. The glove features a first protective structure or structures secured to a first base layer to protect the distal phalange bone of the worker, and a second protective structure or structures secured to a second base layer to protect the intermediate phalange and proximal phalange bones of the worker. The separation between the base layers provides for enhanced flexibility of the distal phalange, and allows for flexibility when performing tasks that require agility and dexterity.

22 Claims, 10 Drawing Sheets

(56) References Cited

U.S. PATENT DOCUMENTS 5,560,044 A 10/1996 Masley
5,625,900 A 5/1997 Hayes
5,640,712 A * 6/1997 Hansen ..... A41D 19/01523 2/16
5,687,424 A 11/1997 Masley
5,740,551 A 4/1998 Walker
5,815,839 A 10/1998 Safford
5,822,796 A 10/1998 Harges, Jr. et al.
6,029,276 A 2/2000 White
6,098,199 A 8/2000 Barkin
6,119,271 A * 9/2000 Byon ..... A63B 21/065 2/161.2
6,389,601 B2 5/2002 Kleinert
6,415,443 B1 7/2002 Schierenbeck et al.
6,415,445 B1 7/2002 Nishijima et al.
6,427,249 B1 8/2002 Mattesky
6,427,250 B1 8/2002 Stull et al.
6,536,050 B1 3/2003 Hill
6,559,453 B2 5/2003 Lundqvist
6,718,555 B2 4/2004 Hofmann
6,732,378 B2 5/2004 Novak
6,836,905 B2 1/2005 Sande
6,961,960 B2 * 11/2005 Gold ..... A41D 19/01523 2/16
7,000,256 B2 2/2006 Kleinert
7,000,257 B2 2/2006 Bevier
7,000,259 B2 2/2006 Matechen
7,370,373 B2 5/2008 Kohler
7,478,440 B2 1/2009 Dolenak
D608,978 S 2/2010 Votel
D609,861 S 2/2010 Fitzgerald
D619,305 S 7/2010 Fitzgerald
D621,552 S 8/2010 Fitzgerald
D621,553 S 8/2010 Fitzgerald
7,774,860 B2 8/2010 Kohler
D625,051 S 10/2010 Fitzgerald
7,937,773 B1 * 5/2011 Kleinert ..... A41D 19/01523 2/159
D648,490 S 11/2011 Choi et al.
D650,532 S 12/2011 Choi
8,137,606 B2 3/2012 Thompson et al.
8,528,117 B2 9/2013 Asiaghi
D695,968 S 12/2013 Ruminski
D695,969 S 12/2013 Ruminski
D701,349 S 3/2014 Miller et al.
D703,389 S 4/2014 Ruminski
D717,498 S 11/2014 Leach
8,935,812 B2 1/2015 Safford
D721,868 S 2/2015 Fisher
D722,208 S 2/2015 Votel et al.
8,950,015 B2 2/2015 Gibby
D733,364 S 6/2015 Choi et al.
D745,746 S 12/2015 Hughes et al.
9,198,474 B1 12/2015 Hacobian
D748,343 S 1/2016 Wyatt et al.
9,241,519 B2 1/2016 Jaeger
D750,845 S 3/2016 Kawano
9,298,326 B2 3/2016 Spencer
D756,039 S 5/2016 Jaeger
9,346,202 B2 5/2016 Gellis
D759,318 S 6/2016 Wyatt et al.
D776,364 S 1/2017 Kawano et al.
D788,402 S 6/2017 Votel et al.
D796,779 S 9/2017 Votel et al.
D809,714 S 2/2018 Lim
D818,666 S 5/2018 Urbelis
D824,111 S 7/2018 Lim
D824,599 S 7/2018 Lim
D824,640 S 8/2018 Votel et al.
2005/0183184 A1 8/2005 Hatch et al.
2005/0251893 A1 11/2005 Hayden et al.
2006/0048259 A1 3/2006 Keppler et al.
2006/0048268 A1 3/2006 Loos
2006/0212990 A1 9/2006 Mattersky
2007/0136928 A1 6/2007 Dolenak
2007/0220655 A1 9/2007 Aoki
2008/0109933 A1 5/2008 Dolenak
2008/0109935 A1 5/2008 DeBlasis
2008/0263747 A1 10/2008 DeBlasis et al.
2009/0019613 A1 1/2009 Carcaterra et al.
2009/0038052 A1 2/2009 Gellis
2009/0288236 A1 11/2009 Hawkes
2010/0007111 A1 3/2010 Jaeger
2010/0090966 A1 4/2010 Gregorio
2010/0186457 A1 7/2010 Zhu
2010/0275342 A1 11/2010 Sweeney et al.
2011/0047672 A1 3/2011 Hatfield
2011/0067165 A1 3/2011 Fream et al.
2011/0068028 A1 3/2011 Harriman et al.
2012/0054937 A1 3/2012 Robaire et al.
2012/0128995 A1 5/2012 Leto et al.
2012/0159681 A1 6/2012 Gibby
2012/0204321 A1 8/2012 Connelly et al.
2012/0227157 A1 9/2012 Kleinert
2012/0227158 A1 9/2012 Ashworth et al.
2012/0240308 A1 9/2012 Thompson
2013/0074242 A1 3/2013 Moreland et al.
2013/0104285 A1 5/2013 Nolan
2013/0180027 A1 7/2013 Rock
2013/0305430 A1 11/2013 Tomono
2014/0026282 A1 1/2014 Rusakov et al.
2014/0033392 A1 2/2014 Bulan et al.
2014/0059739 A1 3/2014 Gellis
2014/0143926 A1 5/2014 Brown et al.
2014/0157832 A1 6/2014 Thompson et al.
2014/0215685 A1 8/2014 Bush
2015/0047088 A1 2/2015 Contant et al.
2015/0119200 A1 4/2015 Jones
2015/0128324 A1 5/2015 Baker et al.
2015/0185872 A1 7/2015 Leto
2015/0220146 A1 8/2015 Fisher et al.
2016/0135520 A1 5/2016 Jung
2016/0235140 A1 8/2016 Hoppe
2017/0265540 A1 9/2017 Kolmes

FOREIGN PATENT DOCUMENTS

CN 202680583 1/2013
CN 202821761 3/2013
CN 203152571 8/2013
CN 203563727 4/2014
CN 203618841 6/2014
CN 203662075 6/2014
CN 205018357 2/2016
WO 2010151727 12/2010

* cited by examiner

INDUSTRIAL IMPACT SAFETY GLOVE

CROSS-REFERENCE TO RELATED APPLICATIONS

This application claims the benefit of U.S. patent application Ser. No. 29/619,633, filed Sep. 29, 2017, for an "INDUSTRIAL IMPACT SAFETY GLOVE", currently pending, and U.S. patent application Ser. No. 29/619,648, filed Sep. 29, 2017 for an "INDUSTRIAL IMPACT SAFETY GLOVE", currently pending, the contents of which are incorporated by reference herein and the priority of which are hereby claimed.

FIELD

The present disclosure relates to safety gloves, and more particularly to industrial impact safety gloves configured to protect areas of the wearer's hand from injuries sustained from contact with industrial or other work equipment, while at the same time providing flexibility and dexterity for the user. The glove includes a first protective structure or set of structures secured to a first base layer to protect the distal phalanx bone and surrounding tissue, and a second protective structure or set of structures secured to a second base layer to protect the intermediate and proximal phalanx bones and surrounding tissue of the worker. The separation between the base layers provides for enhanced flexibility of the distal phalanx, and allows for flexibility when performing tasks that require agility and dexterity.

BRIEF DESCRIPTION OF DRAWINGS

Various aspects and features of the present disclosure are described herein with reference to the drawings, wherein like numerals refer to similar or identical elements and.

DETAILED DESCRIPTION

Figure 1:
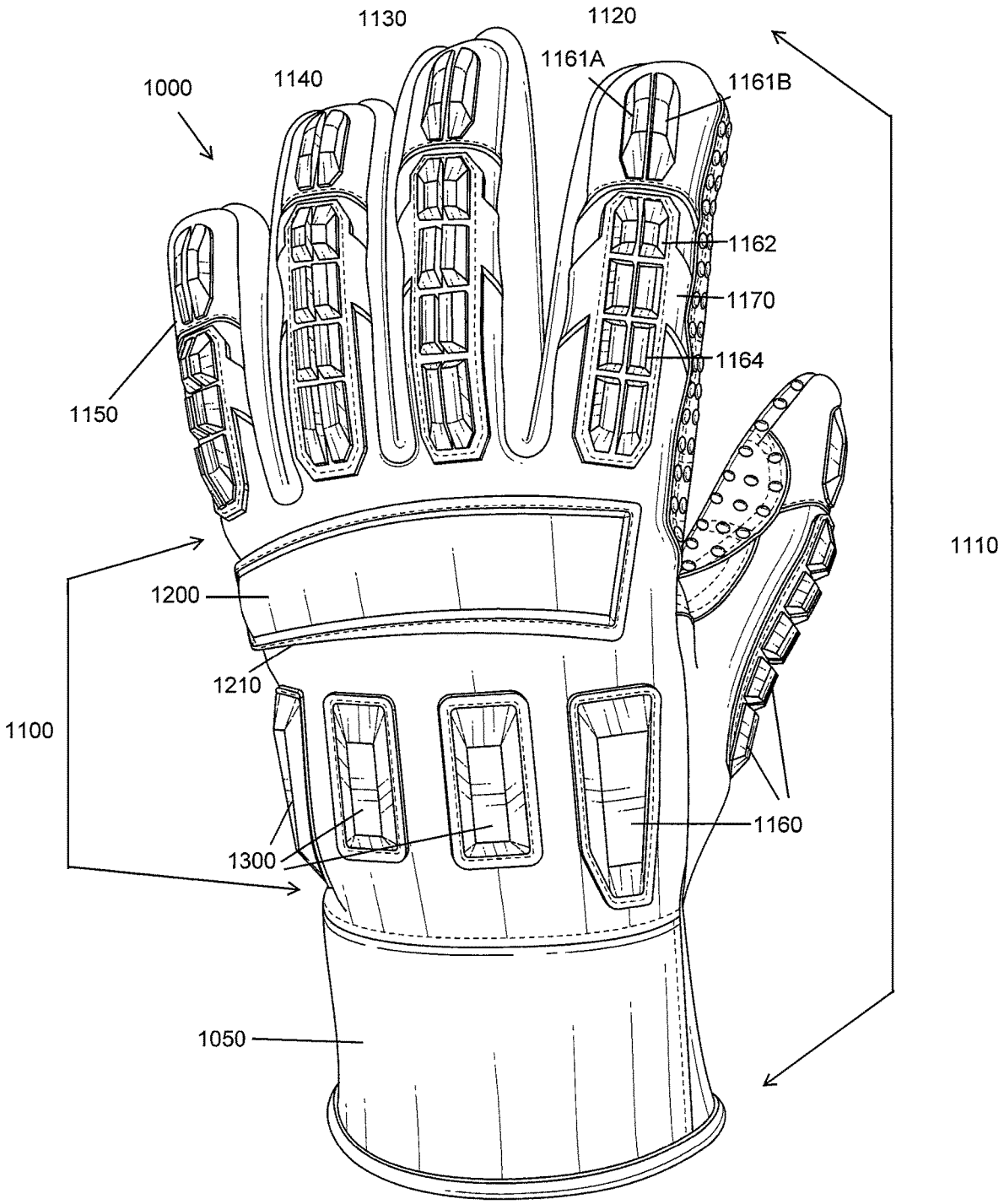
FIG. 1 illustrates a perspective view of an industrial impact safety glove according to an embodiment of the present disclosure.

In an example embodiment of the present invention, an industrial impact safety glove for protecting the hand of a worker is provided. The impact protection glove is configured to protect the hand of the worker while still providing flexibility and dexterity to the user. The glove features a plurality of protective structures on the dorsal, or top, side of the glove. For example, on the dorsal side of the finger portions of the glove, a set of protective structures extends in a line, providing protection to the finger of the worker, including the bones, tendons, ligaments, fingernails, and other soft tissue of the finger. In particular, a protective structure or set of protective structures are arranged to protect the intermediate phalanx and proximal phalanx bones of the worker, as well as the surrounding soft tissue, and a separate protective structure is arranged to protect the distal phalanx bone, and its surrounding soft tissue, of the worker. The separation of the protective structures at the area between the distal and intermediate phalanges provides for enhanced flexibility of the distal phalanx, and allows for dexterity when performing small-scale tasks that require agility and dexterity, such as detail work or tasks that require the handling of small tools.

In aspects of the present disclosure, the base layers support multiple protective structures on each base layer.

In further aspects of the present disclosure, the protective structures may be divided approximately in half in a longitudinal direction, creating pairs of first and second substructures, providing enhanced flexibility for the user.

In further aspects of the present disclosure, a lateral protective structure may be provided to protect the knuckle area of the user. In certain embodiments, the lateral protective structure may be connected via a common base layer to the protective structures protecting the intermediate and proximal phalanges on each finger pocket. In certain embodiments, the lateral protective structure may instead be secured to its own base layer, separate and apart from the other base layers of the glove.

In further aspects of the present disclosure, an additional set of protective structures may be provided on the dorsal side of the glove, configured to extend across and protect the metacarpal bones of the user. In certain embodiments, these protective structures may be secured to a single base layer extending across and protecting the metacarpal bones of the user. In other embodiments, these protective structures may each be secured to individual base layers, with the set of base layers extending across and protecting the metacarpal bones of the user.

Provision of a glove with such protective structures may be desired to guard the wearer from impact trauma, cuts, punctures, hazardous chemicals and fluids, wounds, abrasions, and the like. Certain industries require gloves having specific levels of protection suitable for use in the environments typical to that particular industry, and various standard rating systems have been implemented to enable a user to identify whether a particular safety glove would be suitable for use in the intended industry. For example, the European Norm (EN) designates whether a particular article is compliant with essential requirements. EN 388 designates whether a glove provides adequate protection from mechanical risks; EN 374-1 designates whether a glove provides chemical resistance and micro-organism resistance; and EN 420 designates whether a glove meets the general construction, fitness, and safety requirements for protective gloves. Additionally, markings such as the European Conformity ("CE Marking") are utilized by glove manufacturers to indicate that a particular article complies with the relevant directives for that particular class of articles. For example, the Personal Protection Equipment (PPE) Directive 89/686/EEC is the relevant directive for achieving CE Marking status.

Referring generally to FIGS. 1 through 11, example embodiments of the industrial impact safety glove are shown. Glove 1000 can be formed from one fabric or multiple fabrics coupled together to form a shell 1010 in the shape of a hand, with the shell having a nominal palm side and a dorsal side opposite the palm side. As used herein, "fabric" may refer to any sheet of material composed of natural or synthetic fibers, or a combination of natural and synthetic fibers. For example, in one embodiment, shell may comprise fabric containing approximately 86% polyester and 14% spandex. The shell includes a body portion 1100 configured to cover the metacarpal and carpal bones of the user's hand and the surrounding soft tissue, and a set of phalangeal, or finger, pockets 1105 configured to contain a thumb and four fingers of a user, and to cover the proximal, intermediate, and distal phalanx bones of the user and the surrounding soft tissue.

In exemplary embodiments, the set of phalangeal pockets 1105 includes a thumb pocket 1110, configured to contain the thumb of the user; a first phalangeal pocket 1120, configured to contain the "index finger" of a user; a second phalangeal pocket 1130, configured to contain the "middle finger" of a user; a third phalangeal pocket 1140, configured to contain the "ring finger" of a user; and a fourth phalangeal pocket 1150, configured to contain the "pinky" or last finger of a user. The shell 1010 of glove 1000 may also include a wrist portion 1050 configured to cover, at least partially, the wrist and a portion of forearm of the user.

Various sizes of the protective glove 1000 may be provided, such as "small" (measuring approximately 35 cm from the tip end of the "middle finger" pocket to the open end of the wrist portion), "medium" (measuring approximately 40 cm), and "large" (measuring approximately 50 cm), such that an appropriate fit may be provided for a variety of workers. Although the glove 1000 depicted in FIGS. 1 through 11 depict alternate views and embodiments of a right-handed glove, it may be understood that the present disclosure is directed to gloves configured to protect both a right hand and a left hand, and that reference to the right-handed glove depicted in FIGS. 1 through 11 are intended to interchangeably apply to a left-handed glove.

As discussed in more detail below and as shown in FIGS. 1 through 11, the glove 1000 is provided with a plurality of protective structures 1160 on the dorsal side of the glove 1000. The protective structures are secured to base layers 1170 using techniques recognized by those skilled in the art, such as threading and stitching, sonic welding, and so forth. The threading may be comprised of any conventional material, including natural or synthetic materials, and may include, for example and without limitation, aramid fibers. The protective structures 1160 may be formed from thermoplastic rubber ("TPR"). The protective structures 1160 may have a preferred thickness of about 6 mm on areas configured to protect the knuckles and the proximal, intermediate, and distal phalanges of the user, and may have a preferred thickness of about 2 to 5 mm on areas configured to protect the metacarpal bones of the user. The protective structures 1160 may have a preferred hardness of about 30 to about 40 Shore A, although other constructions, materials, heights, and durability may be implemented in various embodiments of the present disclosure.

With reference to the embodiment pictured in FIG. 1, phalangeal pockets 1110, 1120, 1130, 1140, and 1150 feature a plurality of protective structures 1160 on the dorsal side of the glove 1000 configured to protect the dorsal side of the thumb and four fingers of the user. Generally, the protective structures 1160 on the phalangeal pockets 1105 are arranged in a radial line along the respective phalangeal pocket 1105, on the dorsal side of the glove, so as to protect the proximal phalanges, intermediate phalanges, and distal phalanges of each finger.

Figure 2:
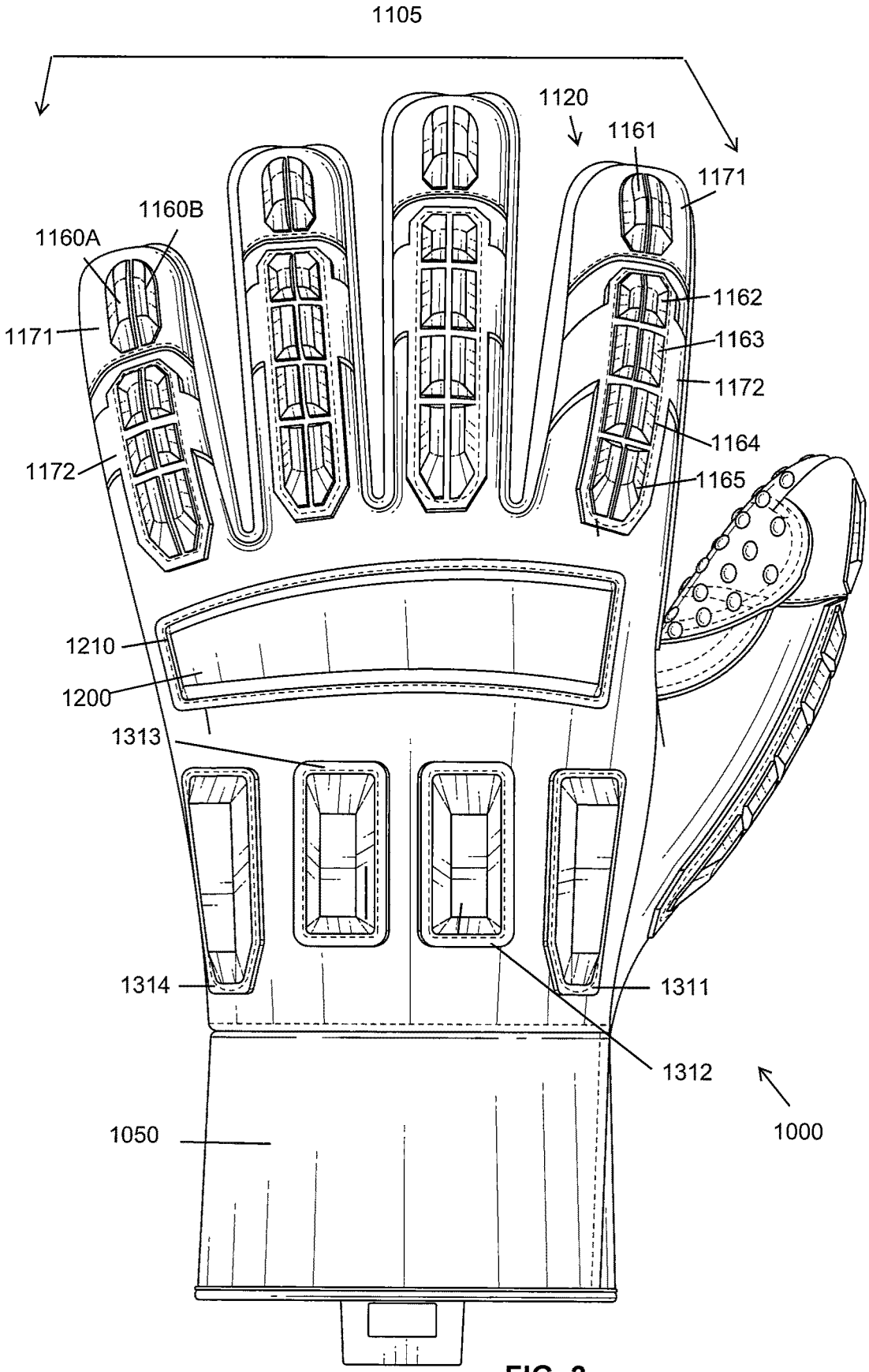
FIG. 2 is a top, or dorsal, view of the industrial impact safety glove depicted in FIG. 1.

For example, with reference to first phalangeal pocket 1120, as shown in FIGS. 1 and 2, a distal phalangeal protective structure 1161 is arranged on the phalangeal pocket towards the "fingertip" portion of the glove, configured to protect the distal phalange of the user. Distal phalangeal protective structure 1161 is secured to a distal base layer 1171 featured on the phalangeal pocket. As discussed in more detail herein, the glove 1000 features a plurality of base layers 1170 on the shell of the glove for support of the protective structures 1160. For ease of reference, base layer 1170 that provides support for the distal phalangeal protective structure 1161 will be referred to herein as the distal phalangeal base layer 1171.

Protective structures 1160, such as distal phalangeal protective structure 1161, may be subdivided into protective substructures 1160A, 1160B, and so forth. Generally, protective substructures are created by a longitudinal division of the surface of a protective structure 1160, such that each protective substructure, such as 1160A, 1160B, forms half of the larger protective structure 1160. However, any number of protective substructures may be produced by appropriate division of protective structure 1160 into the desired number of substructures.

As may be appreciated, the use of protective substructures allows for enhanced flexibility of the user. Due to the enhanced flexibility provided by the use of protective substructures, it may be preferable that the protective structures 1160 arranged on the phalangeal pockets 1105 are each divided into protective substructures 1160A, 1160B to afford greater flexibility to the user's fingers. Because protective substructures form smaller, subdivided portions of the larger protective structure 1160, it is to be understood that each pair or set of protective substructures 1160A, 1160B are each secured to the common base layer 1170 meant to support its respective protective structure 1160. For example and without limitation, as shown in FIGS. 1 and 2, distal phalangeal protective structure 1161 may be subdivided into two protective substructures 1161A, 1161B, but each of the protective substructures 1161A, 1161B are secured to the same distal phalangeal base layer 1171.

Similarly, distal phalangeal base layer 1171 may support more than one distal phalangeal protective structure 1161. For example and without limitation, in "large" gloves 1000 as referenced above, there may be multiple distal phalangeal protective structures 1161 on one phalangeal pocket 1105 configured to cover the distal phalange of a particular finger. To provide enhanced flexibility and comfort, the multiple distal phalangeal protective structures 1161 may also be subdivided into protective substructures 1161A, 1161B.

Phalangeal pockets 1105 may feature additional protective structures 1160 arranged to protect the remaining portion of the user's finger. For example, with continuing reference to first phalangeal pocket 1120, as shown in FIGS. 1 and 2, first phalangeal pocket 1120 features a set of additional protective structures 1160 extending along the finger portion, away from the "fingertip" portion of the glove and towards the body portion 1100 of the glove 1000. More particularly, these additional protective structures 1160 are configured to primarily protect the intermediate phalanges and proximal phalanges of the user. For ease of reference herein, this additional protective structure 1160 or set of protective structures 1160 configured for protection of this area may be referred to as the proximal phalangeal protective structures. In a preferred embodiment, such as shown on the first phalangeal pocket 1120 of FIGS. 1 and 2, the proximal phalangeal protective structures may include a plurality of proximal phalangeal protective structures 1162, 1163, 1164, and 1165. However, the number or arrangement of the proximal phalangeal protective structures is not meant to be limited to any particular number, as there may, for example, be a preference for less proximal phalange protective structures when more structured protection is preferred in the glove, and there may, for example, be a preference for additional proximal phalange protective structures when more flexibility is preferred in the glove.

In certain embodiments, proximal phalangeal protective structures 1162, 1163, and so forth may be subdivided into protective substructures (such as proximal phalangeal protective substructures 1162A, 1162B, 1163A, 1163B, and so forth), similar to the substructures 1161A, 1161B of distal phalangeal protective structure 1161. The use of protective substructures along the intermediate and proximal phalangeal section of the glove provides enhanced flexibility, and therefore may be preferred in certain work situations. However, like the distal phalangeal protective structures 1161, the proximal phalangeal protective structures 1162, 1163, 1164, 1165 may remain unitary, as may be preferred for a glove providing a more rigid structure.

As shown in the example embodiment of FIGS. 1 and 2, the proximal phalangeal protective structures 1162, 1163, and so forth are secured to a second base layer 1170 on the phalangeal pocket of the glove. For ease of reference, base layer 1170 that provides support to the proximal phalangeal protective structures will be referred to herein as the proximal phalangeal base layer 1172. As shown in FIGS. 1 and 2, the proximal phalangeal base layer 1172 supports, via a single common proximal base layer, each of the proximal phalangeal protective structures 1162, 1163, and so forth. Proximal phalangeal base layer 1172 is separated from distal phalangeal base layer 1171 by at least a portion of fabric. The separation of these two base layers 1172 and 1171 provides flexibility to the user at the "fingertip" portion of the glove.

It may be appreciated that this flexibility at the fingertip, created by the separation of the base layers on the finger pocket of the glove, is an improvement over prior art that simply provides for separated protrusions or ongoing padding along a finger pocket. By using two distinct base layers on the finger pocket, and providing a portion of fabric to separate these two base layers, the tip of the finger is allowed greater dexterity, which is preferred when performing detailed tasks using small tools or apparatuses that require such dexterity. The dexterity is, in turn, provided without sacrificing protection of the fingers from impacts and potential harm.

Figure 3:
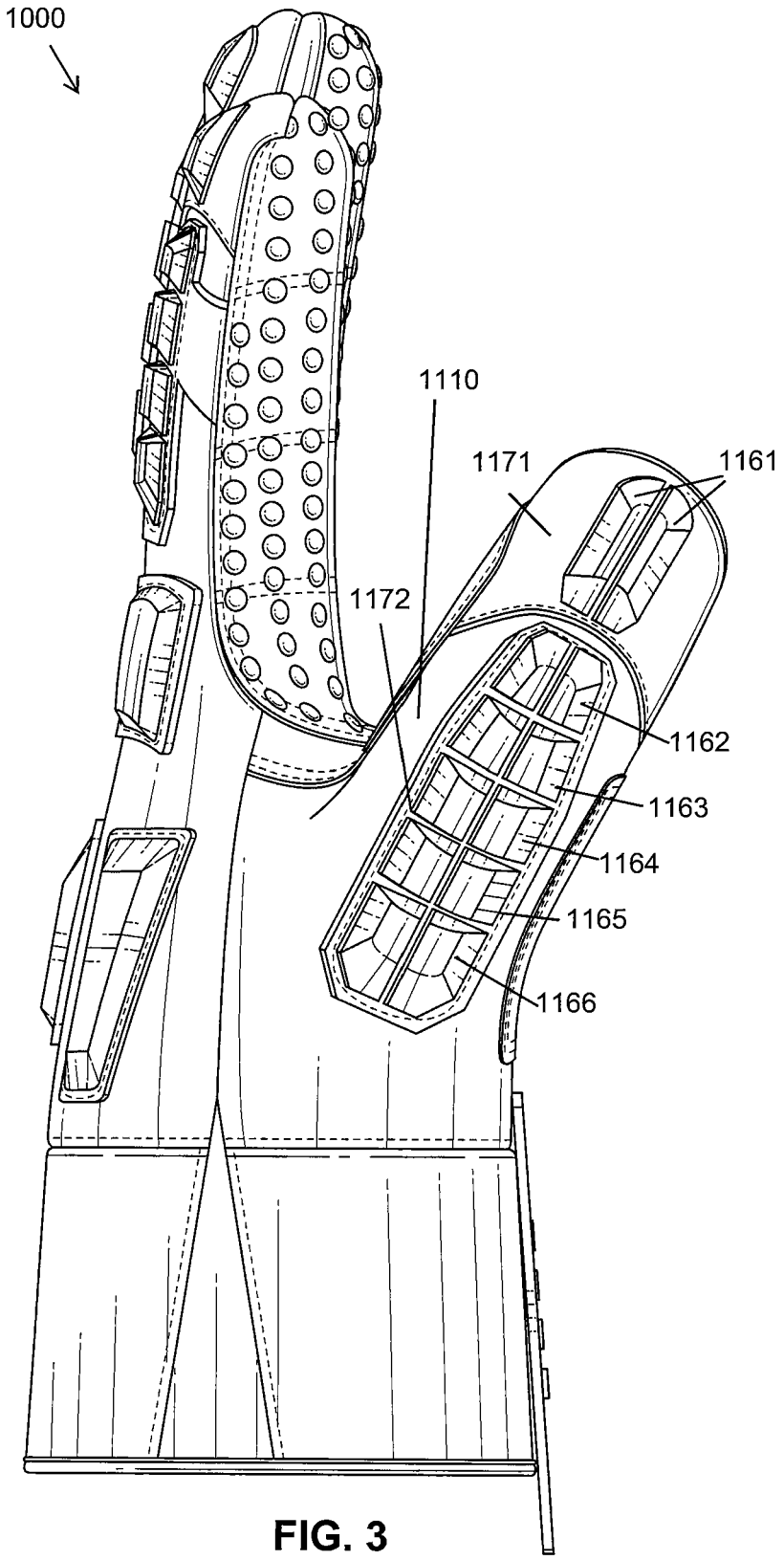
FIG. 3 is a side view of the industrial impact safety glove depicted in FIG. 1, depicting the side of the glove featuring the thumb pocket.

As shown in more detail in FIG. 3, thumb pocket 1110 may also be provided with a distal phalangeal protective structure 1161, configured to protect the distal phalange of the thumb of the user. Distal phalangeal protective structure 1161 on the thumb pocket 1110 is secured to a distal phalangeal base layer 1171 featured on the thumb pocket. Extending along the thumb pocket 1110 in the direction of the body portion 1100 of the glove 1000 is a set of proximal phalangeal protective structures 1162, 1163, 1164, 1165, 1166 configured to primarily protect the proximal phalange of the thumb of the user. Proximal phalangeal protective structures 1162, 1163, and so forth are each secured to a singular proximal phalangeal base layer 1172. As shown in FIG. 3, the distal phalangeal base layer 1171 and proximal phalangeal base layer 1172 are separated by at least a portion of fabric on the thumb pocket 1110, thereby providing enhanced flexibility of the user's thumb.

Turning now to the body portion 1100 of the glove 1000, further protective structures 1160 may be provided. For example, as shown in FIGS. 1 and 2, there may be provided a protective structure at the start of the body portion 1100 adjacent the phalangeal pockets 1120, 1130, 1140, and 1150 and extending laterally across the dorsal surface of the glove 1000. Generally, this lateral protective structure 1200 is positioned to protect the "knuckle" portion of the user's hands, corresponding to the region where the metacarpal bones abut the proximal phalanges. Lateral protective structure 1200, like all protective structures 1160 provided on the glove 1000, is secured to a base layer 1170. For ease of reference herein, this base layer may be referred to as the lateral base layer 1210.

Body portion 1100 may also feature a plurality of additional protective structures 1160 on the dorsal side of the glove, referred to herein as body protective structures 1300. Generally, this body protective structure or structures 1300 are configured to protect at least a portion of the metacarpal bones of the user. The body protective structure or structures 1300 are secured to a base layer or set of base layers 1170, which may be referred to herein as the body base layer 1310. As shown in the embodiment depicted in FIGS. 1 and 2, the body protective structures 1300 may be featured as a set of individualized body protective structures 1301, 1302, 1303, and so forth, wherein the set of individualized body protective structures extend laterally across the body portion 1100 of the glove to cover substantially the entirety of the metacarpal area of the user. As shown in the embodiment of FIGS. 1 and 2, each body protective structure 1301, 1302, 1303, and 1304 is secured to a respective body base layer 1311, 1312, 1313, and 1314 to provide enhanced support for the protective structure. In the embodiment shown in FIGS. 1 and 2, each of these body base layers 1311, 1312, and so forth are separated from each other by at least a portion of fabric, providing enhanced flexibility for the user. However, as discussed in more detail below in reference to the embodiment pictured in FIG. 6, it may be preferable to instead feature a singular body base layer to provide enhanced protection to the metacarpal bones of the user and enhanced rigidity to the glove.

Figure 4:
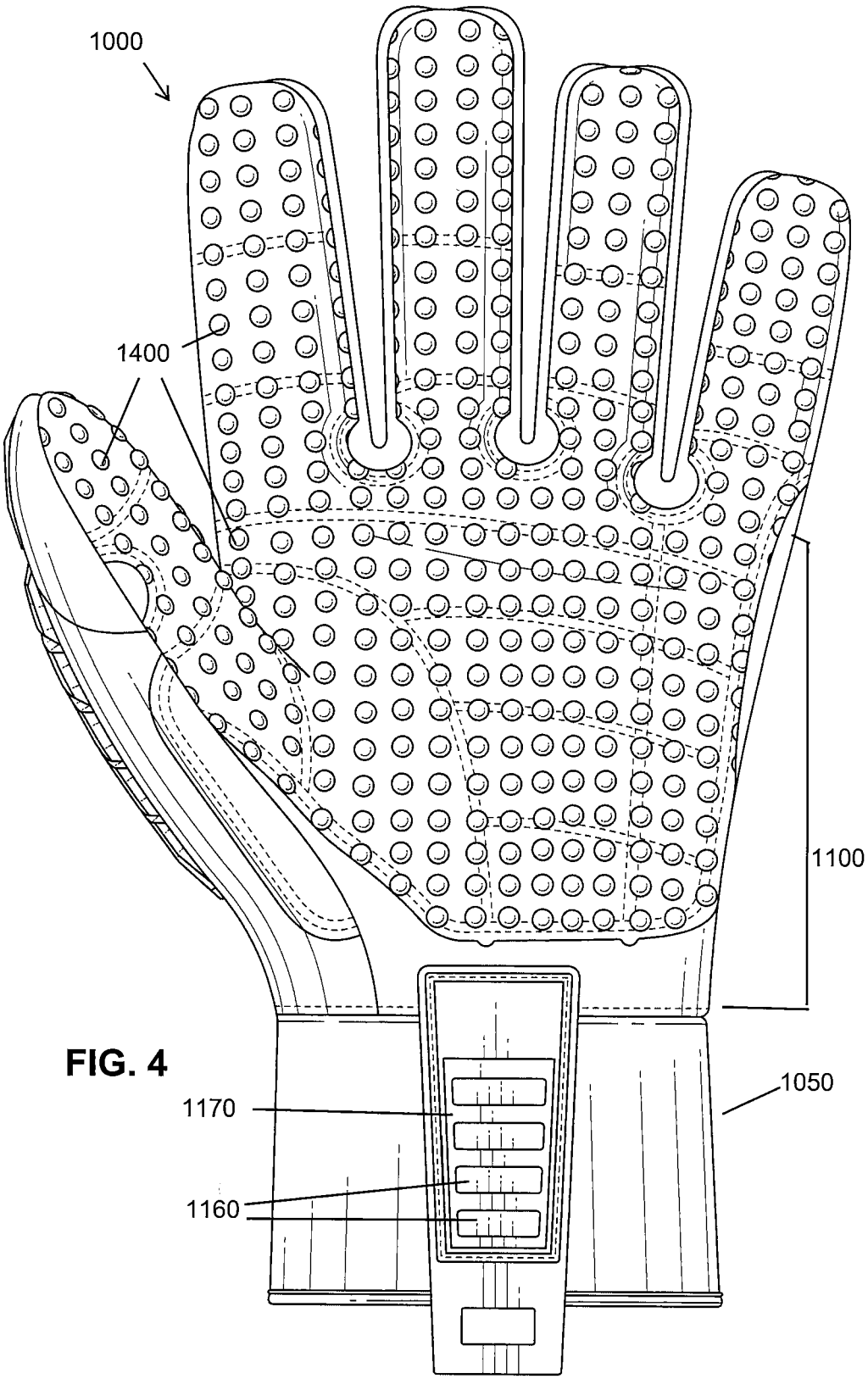
FIG. 4 is a bottom, or palmar, view of the industrial impact safety glove depicted in FIG. 1.

Glove 1000 may be further provided with a wrist portion 1050, substantially cylindrical in form and configured to surround the wrist of the user. In certain embodiments, the wrist portion 1050 may be sized to extend up to a portion of the forearm of the user. For example and without limitation, wrist portion 1050 may be composed of the same materials used for other portions of the glove. As shown in FIG. 4, wrist portion 1050 may be provided with protective structures 1160 on the palm side of the glove 1000 to protect certain areas of the wrist of the user. In certain embodiments, as shown in FIG. 4, the protective structures 1160 on the wrist may be secured to a common base layer 1170 featured on the palm side of the wrist portion 1050 of the glove.

Figure 5:
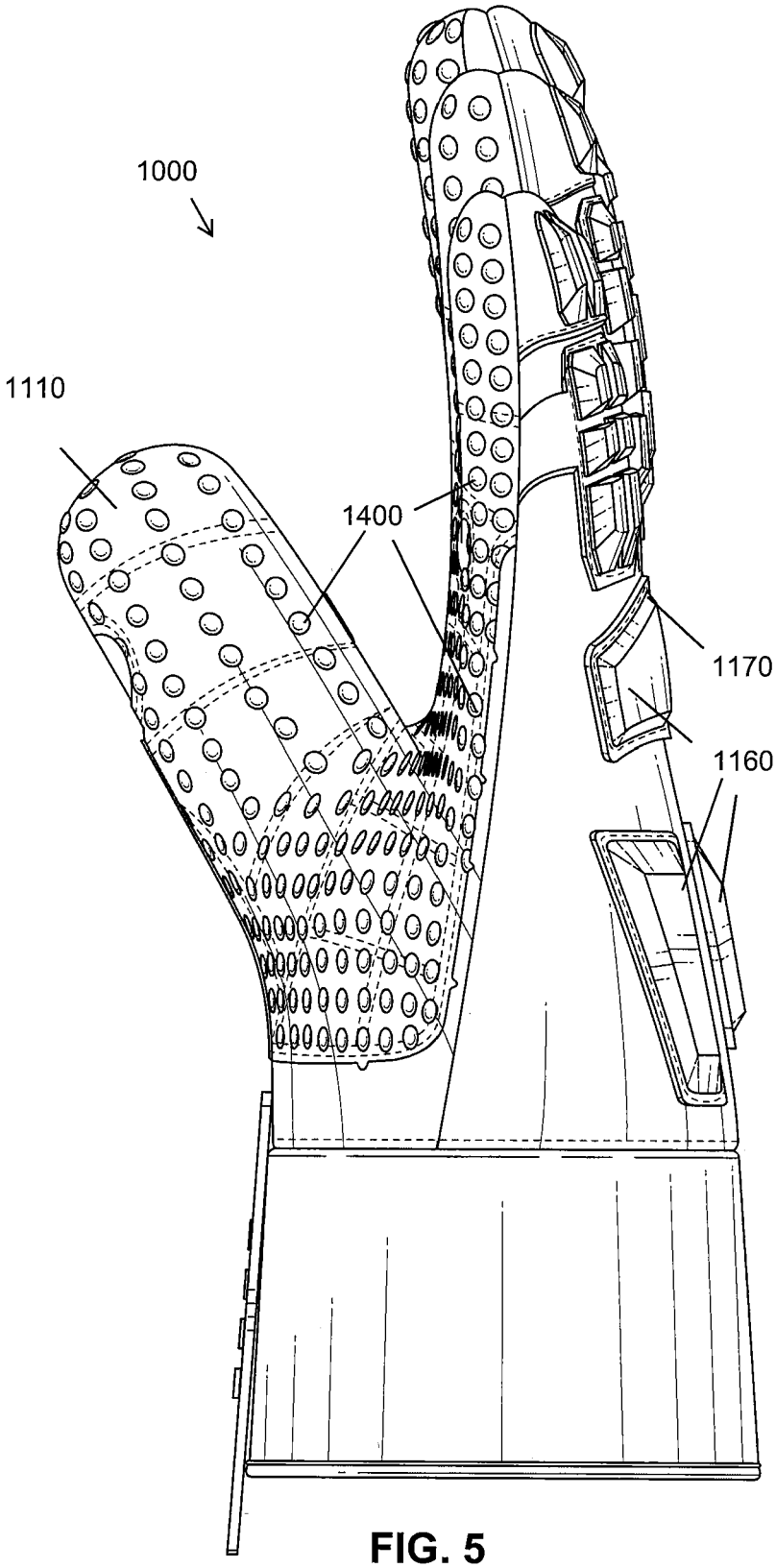
FIG. 5 is a side view of the industrial impact safety glove depicted in FIG. 1, depicting the opposite side of the glove from FIG. 3.
Figure 10:
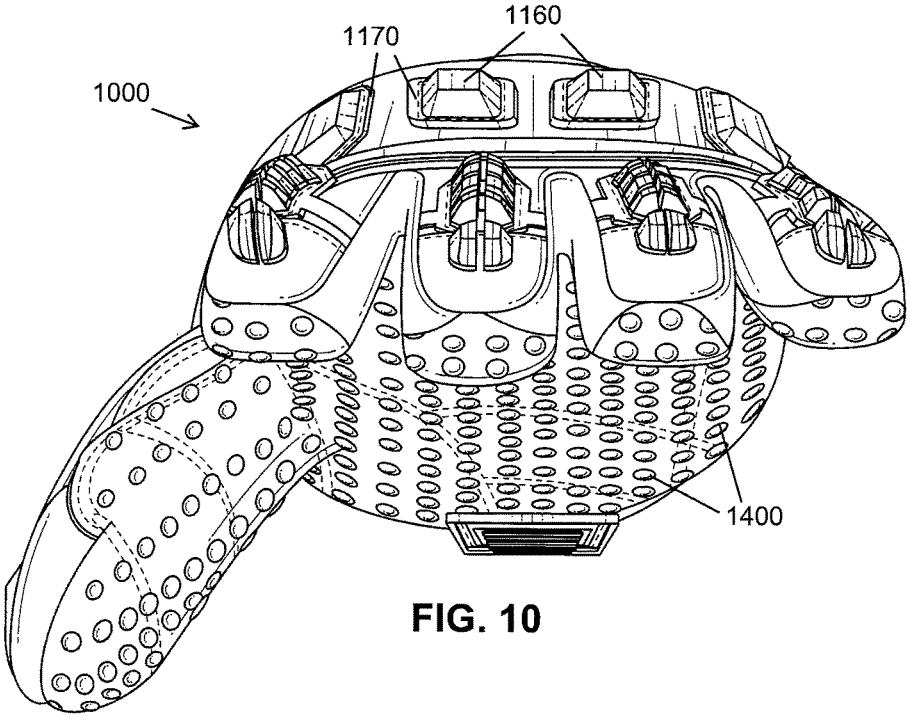
FIG. 10 is a front view of an industrial impact safety glove according to an embodiment of the present disclosure.

As further shown in FIG. 4, which depicts the "palm" side of the glove depicted in FIGS. 1 and 2, glove 1000 may be provided with a plurality of gripping members 1400 across the palm of the glove. Gripping members 1400 may cover substantially the entire palm of the glove, including the palm side of the body portion 1100 and palm side of the phalangeal pockets 1105, to provide enhanced gripping capabilities for the worker during use. As shown in FIG. 5 and FIG. 10, which depicts a side view of the glove 1000 and a top view of the glove 1000, respectively, gripping members 1400 may, in certain embodiments, extend beyond the palm side of the glove 1000 to provide a gripping function on the fingertips of the glove 1000, where the palm side of the glove 1000 meets the dorsal side of the glove 1000.

Turning now to FIGS. 6 to 9, an alternate embodiment of the glove 1000 is shown. Glove 1000 features a body portion 1100; a wrist portion 1050; and a set of phalangeal pockets 1110, 1120, 1130, 1140, and 1150. As discussed in more detail above with reference to FIGS. 1 through 5, the phalangeal pockets feature a plurality of protective structures 1160 on the dorsal side of the glove, so as to protect the proximal phalanges, intermediate phalanges, and distal phalanges of each finger.

Figure 6:
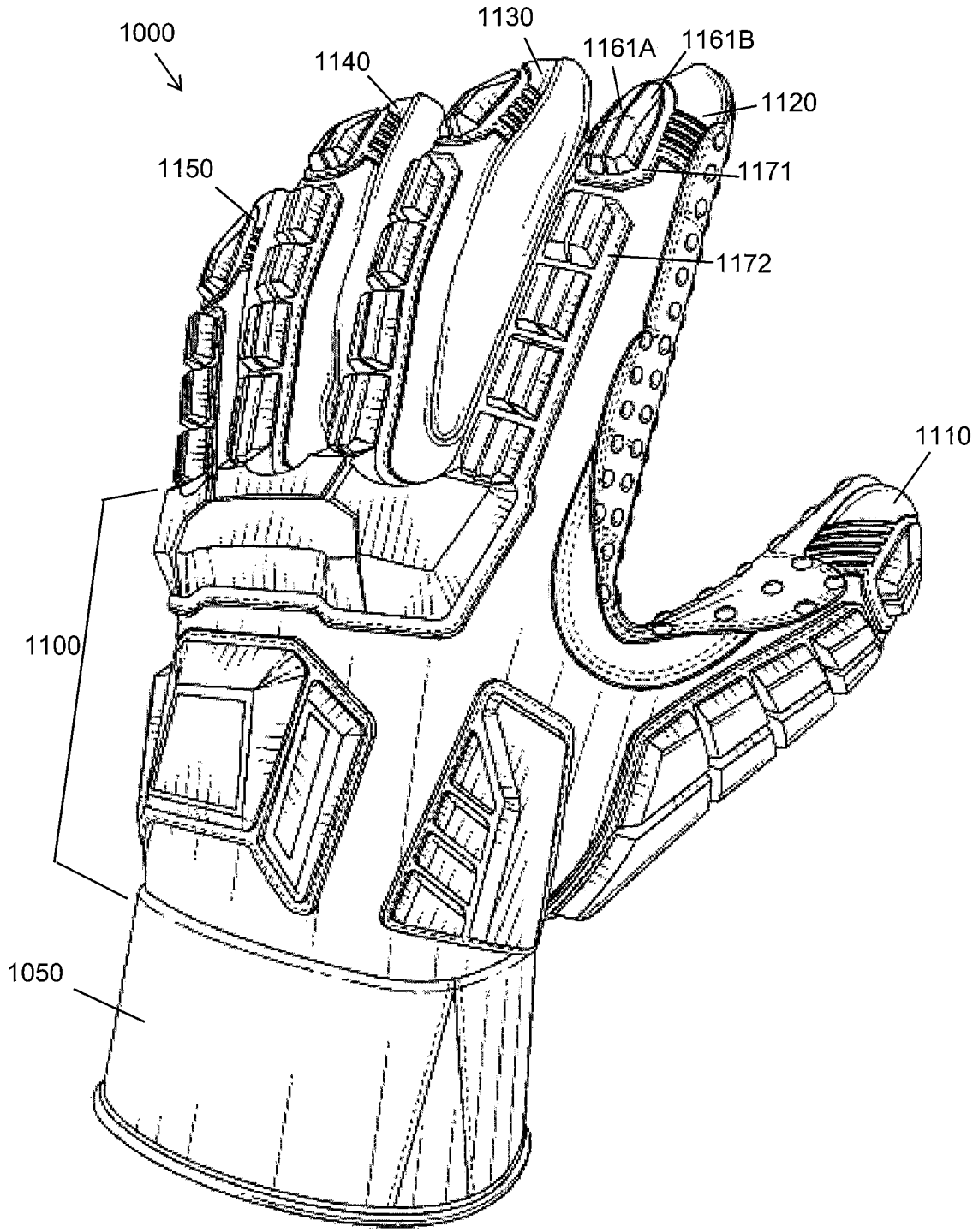
FIG. 6 illustrates a perspective view of an industrial impact safety glove according to a second embodiment of the present disclosure.
Figure 7:
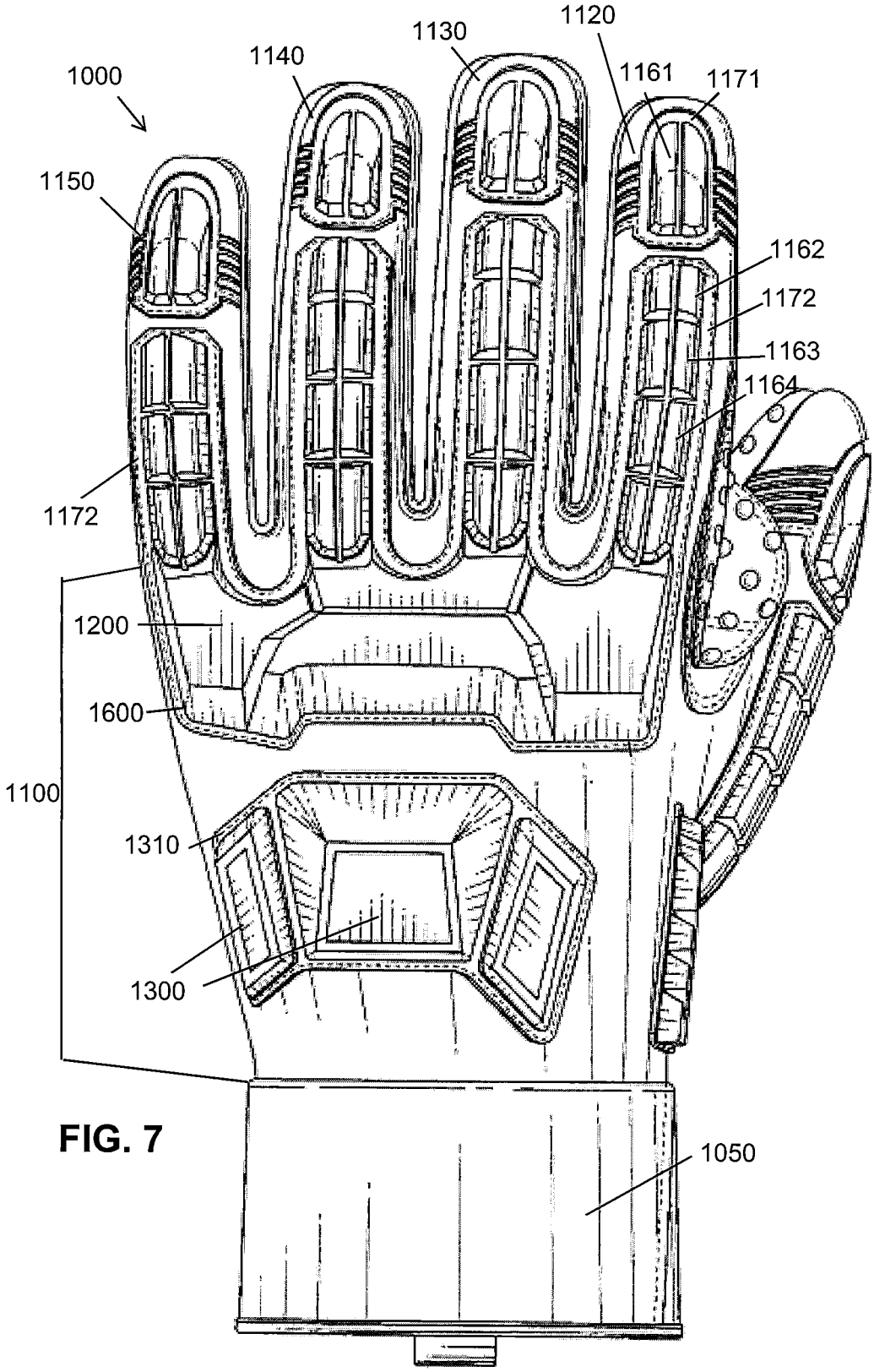
FIG. 7 is a top, or dorsal, view of the industrial impact safety glove depicted in FIG. 6.

For example, with reference to first phalangeal pocket 1120 of FIGS. 6 and 7, a distal phalangeal protective structure 1161 is arranged on the phalangeal pocket towards the "fingertip" portion of the glove, configured to protect the distal phalange of the user. Distal phalangeal protective structure 1161 is secured to a distal base layer 1171 featured on the phalangeal pocket. Distal phalangeal protective structure 1161 may be subdivided into protective substructures 1161A, 1161B, to provide additional flexibility to the user at the distal phalange position. Although the embodiment pictured in FIGS. 6 and 7 depict two protective substructures 1161A, 1161B, protective structure 1161 may be subdivided into any number of protective substructures to achieve the desired flexibility or, conversely, rigidity, appropriate for the user.

Similarly, distal phalangeal base layer 1171 may support more than one distal phalangeal protective structure 1161. For example and without limitation, in "large" sized gloves 1000 as referenced above, there may be multiple distal phalangeal protective structures 1161 secured to one distal phalangeal base layer 1171. To provide enhanced flexibility, the multiple distal phalangeal protective structures may, in turn, also be subdivided into protective substructures.

As shown in FIGS. 6 and 7, first phalangeal pocket includes additional protective structures 1160 configured to protect the remaining portion of the user's index finger. For example, first phalangeal pocket 1120 features a set of additional protective structures 1162, 1163, 1164, and 1165 extending along the finger portion, away from the distal, or "fingertip" portion of the glove, and towards the body portion 1100 of the glove. More particularly, these additional protective structures 1162, 1163, 1164, and 1165 are configured to primarily protect the intermediate phalanges and proximal phalanges of a user's finger. For ease of reference herein, these additional protective structures 1162, 1163, 1164, and 1165 may be referred to as the proximal phalangeal protective structures. The number or arrangement of the proximal phalangeal protective structures is not intended to be limited to a set of four proximal phalangeal protective structures, and there may be, for example, a preference for less than four proximal phalangeal protective structures on a relatively smaller-sized glove or when more structured protection is preferred in the glove, and there may be, for example, a preference for more than four proximal phalangeal protective structures on a relatively larger-sized glove or when more flexibility is preferred in the glove.

In certain embodiments, as shown in FIGS. 6 and 7, proximal phalangeal protective structures 1162, 1163, 1164, and 1165 may be subdivided into protective substructures, such as the depicted substructures 1162A, 1162B, 1163A, 1163B, and so forth. The use of protective substructures along the intermediate and proximal phalangeal section of the glove provides enhanced flexibility, and therefore may be preferred in certain work situations. However, like the distal phalangeal protective structure 1161, the proximal phalangeal protective structures 1162, 1163, 1164, 1165 may remain unitary, as may be preferred for a glove providing a more rigid structure.

As shown in the example embodiment of FIGS. 6 and 7, the proximal phalangeal protective structures 1162, 1163, 1164, 1165 are secured to a second base layer, which may be referred to herein as the proximal phalangeal base layer 1172 of the glove 1000.

As shown in FIGS. 6 and 7, the proximal phalangeal base layer 1172 supports, via a single common proximal base layer, each of the proximal phalangeal protective structures 1162, 1163, 1164, and 1165. Proximal phalangeal base layer 1172 is separated from distal phalangeal base layer 1171 by at least a portion of fabric. The separation of these two base layers 1172 and 1171 provides flexibility to the user at the "fingertip" portion of the glove.

As shown in the example embodiment of FIGS. 6 and 7, proximal phalangeal base layer 1172 may extend down to the body portion 1100 of the glove 1000 so as to provide a unitary base layer 1600, comprised of the proximal phalangeal base layer 1172 featured on each of the first, second, third, and fourth phalangeal pockets 1120, 1130, 1140, 1150, providing support for each of the proximal phalangeal protective structures on each phalangeal pockets 1120, 1130, 1140, 1150 of the glove.

In certain embodiments, as is shown in FIGS. 6 and 7, this consolidated unitary base layer 1600 may be of such width as to support an additional protective structure or structures 1160 configured to protect the "knuckle" portion of the user's hands, corresponding to the region where the metacarpal bones abut the proximal phalanges. For example and without limitation, there may be provided a protective structure 1160 extending laterally across the dorsal surface of the glove 1000 on body portion 1100, adjacent the first to fourth phalangeal pockets 1120, 1130, 1140, 1150. This lateral protective structure 1200 may be comprised of one or more protective structures 1160, depending on the relative preference for flexibility versus rigidity of the particular embodiment.

Body portion 1100 of the glove 1000 depicted in FIGS. 6 through 9 may also feature a plurality of additional protective structures on the dorsal side of the glove, referred to herein as body protective structures 1300. Generally, body protective structure or structures 1300 are configured to protect at least a portion of the metacarpal bones of the user. As shown in FIGS. 6 and 7, body protective structure or structures 1300 are secured to a base layer, referred to herein as body base layer 1310. As shown in the embodiment depicted in FIGS. 6 and 7, the body base layer 1310 is a single, unitary base layer, configured to support a body protective structure or set of body protective structures across the metacarpal area of the hand, to provide enhanced protection to the metacarpal bones of the worker.

Glove 1000 may be further provided with a wrist portion 1050, as shown in FIGS. 6 and 7, substantially cylindrical in form and configured to surround the wrist of the user. In certain embodiments, the wrist portion 1050 may be sized to extend up to a portion of the forearm of the user. For example and without limitation, wrist portion 1050 may be composed of the 1050 materials used for other portions of the glove. As shown in FIG. 9, wrist portion 1050 may be provided with protective structures 1160 on the palm side of the glove 1000 to protect certain areas of the wrist of the user. In certain embodiments, as shown in FIG. 8, the protective structures 1160 on the wrist may be secured to a common base layer 1170 featured on the palm side of the wrist portion 1050 of the glove.

Figure 8:
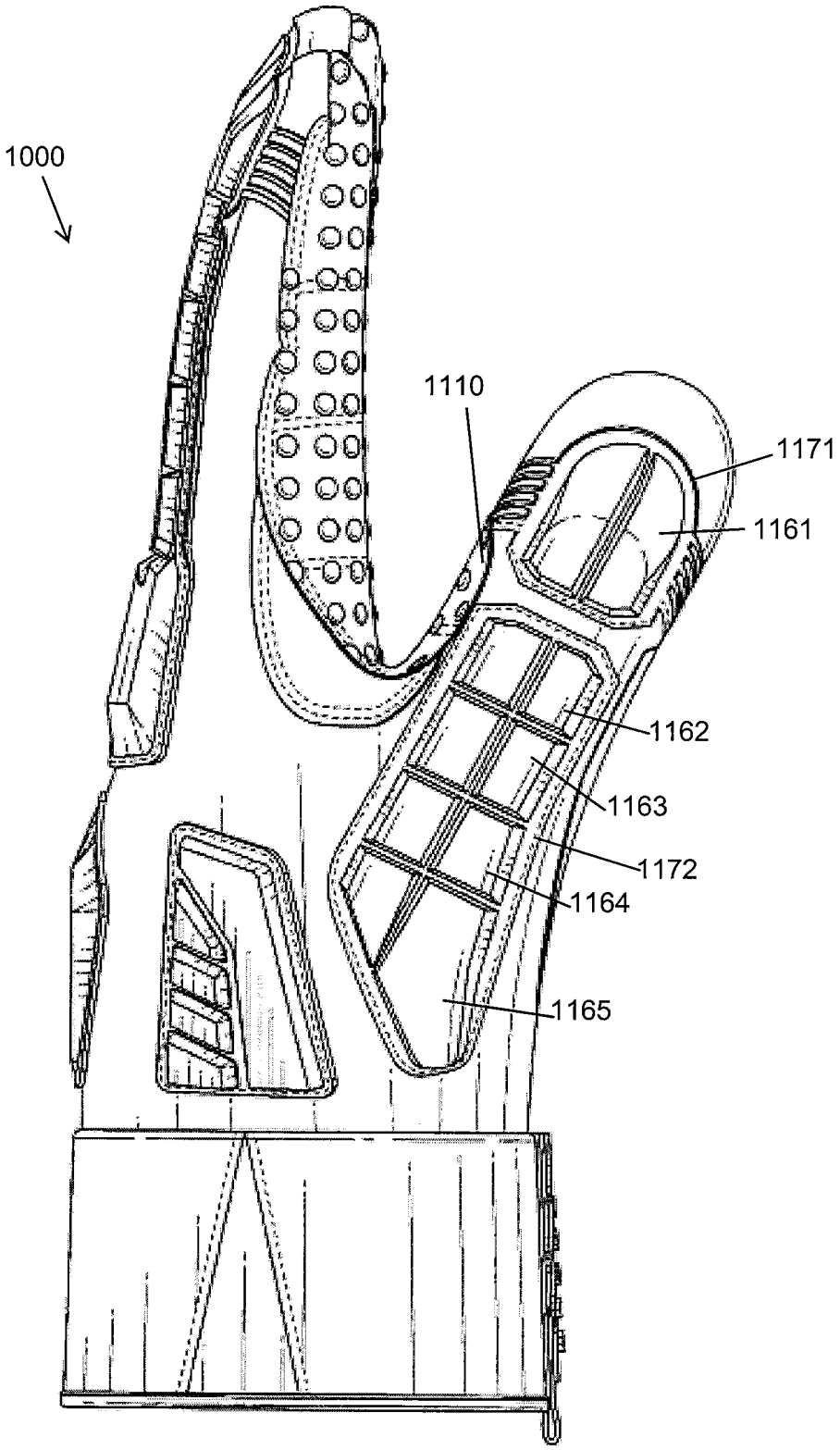
FIG. 8 is a side view of the industrial impact safety glove depicted in FIG. 6, depicting the side of the glove featuring the thumb pocket.
Figure 9:
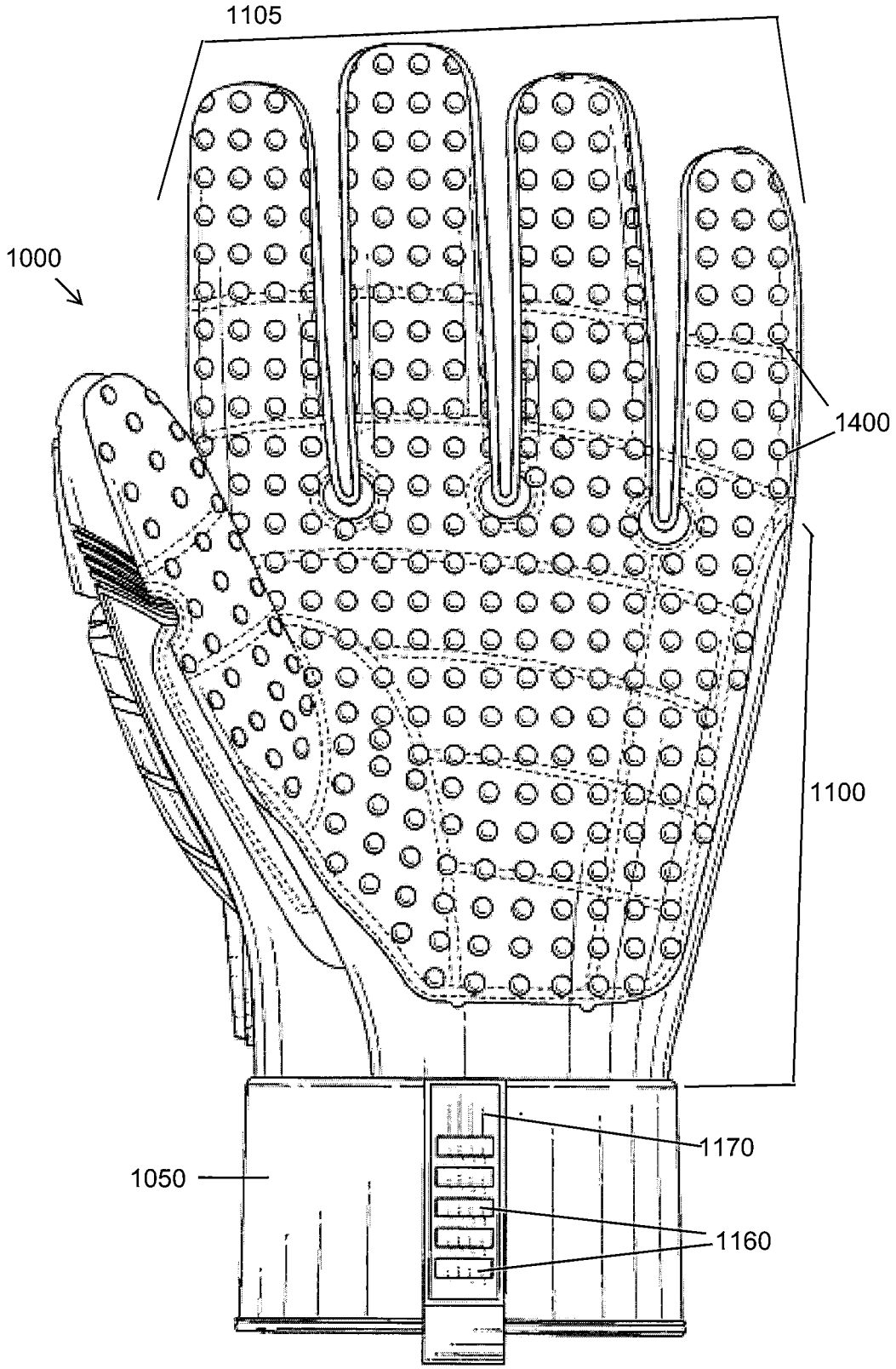
FIG. 9 is a bottom, or palmar, view of the industrial impact safety glove depicted in FIG. 6.

As shown in more detail in FIG. 8, thumb pocket 1110 may also be provided with a distal phalangeal protective structure 1161, configured to protect the distal phalange of the thumb of the user. Distal phalangeal protective structure 1161 on the thumb pocket 1110 is secured to a distal phalangeal base layer 1171 featured on the thumb pocket. Extending along the thumb pocket 1110 in the direction of the body portion 1100 of the glove 1000 is a set of proximal phalangeal protective structures 1162, 1163, 1164, 1165 configured to primarily protect the proximal phalange of the thumb of the user. Proximal phalangeal protective structures 1162, 1163, and so forth are each secured to a singular proximal phalangeal base layer 1172. As shown in FIG. 8, the distal phalangeal base layer 1171 and proximal phalangeal base layer 1172 are separated by at least a portion of fabric on the thumb pocket 1110, thereby providing enhanced flexibility of the user's thumb.

Figure 11:
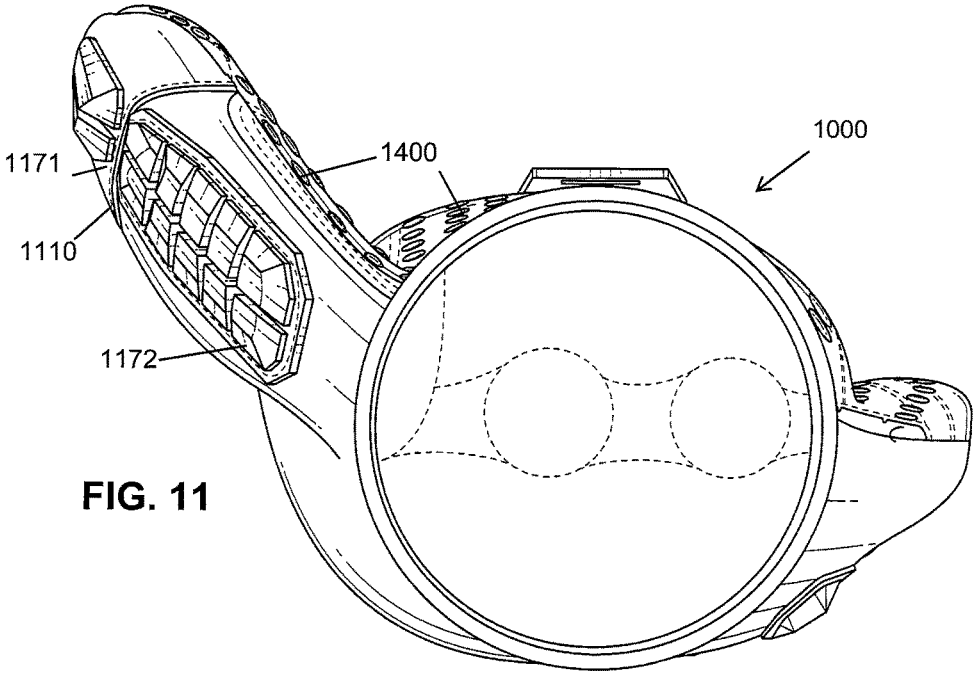
FIG. 11 is a back view of an industrial impact safety glove according to an embodiment of the present disclosure.

As further shown in FIG. 9, which depicts the "palm" side of the glove depicted in FIGS. 6 and 7, glove 1000 may be provided with a plurality of gripping members 1400 across the palm of the glove. Gripping members 1400 may be configured to cover substantially the entire palm of the wearer, and may be featured across the body portion 1100 and phalangeal pockets 1105 on the palm side of the glove 1000, to provide enhanced gripping capabilities for the worker during use. As shown in FIGS. 10 and 11, which depicts a top and a bottom view of the glove 1000, respectively, gripping members 1400 may, in certain embodiments, extend beyond the palm side of the glove 1000 to provide a gripping function on the fingertips of the glove 1000, where the palm side of the glove 1000 meets the dorsal side of the glove 1000.

While the embodiments of the present invention are described with reference to various implementations and exploitations, it will be understood that these embodiments are illustrative and that the scope of the inventions is not limited to them. Many variations, modifications, additions, and improvements are possible. The above description should therefore not be construed as limiting, but merely as exemplifications of particular embodiments.

What is claimed is:

1. A glove comprising:

at least one fabric forming a shell in the shape of a hand, the shell having a body portion and five pockets configured to receive a thumb and four phalanges of a user, and wherein the shell has a palm side and a dorsal side opposite the palm side; and a plurality of protective structures on the dorsal side of the at least one fabric, the plurality of dorsal structures including:

on the thumb pocket, at least one protective structure secured to a first base layer, and at least one additional protective structure secured to a second base layer, the first and second base layers on the thumb pocket being separated by a portion of the at least one fabric, on a first phalangeal pocket, at least one protective structure secured to a first base layer, and at least one additional protective structure secured to a second base layer, the first and second base layers on the first phalangeal pocket being separated by a portion of the at least one fabric, on a second phalangeal pocket, at least one protective structure secured to a first base layer, and at least one additional protective structure secured to a second base layer, the first and second base layers on the second phalangeal pocket being separated by a portion of the at least one fabric, on a third phalangeal pocket, at least one protective structure secured to a first base layer, and at least one additional protective structure secured to a second base layer, the first and second base layers on the third phalangeal pocket being separated by a portion of the at least one fabric, on a fourth phalangeal pocket, at least one protective structure secured to a first base layer, and at least one additional protective structure secured to a second base layer, the first and second base layers on the fourth phalangeal pocket being separated by a portion of the at least one fabric, a lateral protective structure, the lateral protective structure configured to protect a knuckle area of a user, wherein the lateral protective structure is secured to a lateral base layer and extends laterally on the body portion of the shell adjacent to the first, second, third, and fourth phalangeal pockets of the glove, separated from the first, second, third, and fourth phalangeal pockets of the glove by a portion of the at least one fabric, and a set of body protective structures, the set of body protective structures configured to protect metacarpal bones of a user, wherein the set of body protective structures are secured to a set of base layers on the body portion of the glove.

2. The glove of claim 1, wherein the second base layer on each of the thumb pocket, the first phalangeal pocket, the second phalangeal pocket, the third phalangeal pocket, and the fourth phalangeal pocket supports multiple protective structures on each respective second base layer, and wherein the multiple protective structures on each respective second base layer are configured to cover at least a portion of intermediate phalanges of the user.

3. The glove of claim 1, wherein each of the protective structures on the thumb pocket, the first phalangeal pocket, the second phalangeal pocket, the third phalangeal pocket, and the fourth phalangeal pocket is divided approximately in half in a longitudinal direction, creating a plurality of protective substructures.

4. The glove of claim 1, further comprising a plurality of gripping members on the palm side of the glove.

5. The glove of claim 1, wherein the shell further comprises an elongated wrist portion, the elongated wrist portion featuring at least one wrist protective structure on the palm side of the glove.

6. The glove of claim 1, wherein the plurality of protective structures is formed of thermoplastic rubber.

7. A glove, comprising:

at least one fabric forming a shell in the shape of a hand, the shell having a body portion and a plurality of phalangeal pockets extending from the body portion and configured to receive at least one phalange of a user, wherein the shell has a palm side and a dorsal side opposite the palm side;

a first protective structure secured to a first base layer on the dorsal side of a phalangeal pocket, the first protective structure configured to cover a distal phalange of the user; and a second protective structure secured to a second base layer on the dorsal side of the phalangeal pocket, the second protective structure configured to cover at least a portion of an intermediate phalange or at least a portion of a proximal phalange of a user;

wherein the first base layer and the second base layer on the dorsal side of the phalangeal pocket are separated by a portion of the at least one fabric.

8. The glove of claim 7, wherein a third protective structure is secured to the second base layer.

9. The glove of claim 7, wherein each of the protective structures is divided approximately in half in a longitudinal direction, creating a plurality of first and second protective substructures, to provide enhanced flexibility for the user.

10. The glove of claim 7, wherein each phalangeal pocket features a distal phalange protective structure secured to a first base layer on the dorsal side of the phalangeal pocket, the distal phalangeal protective structure configured to cover a distal phalange of the user, and an intermediate phalange protective structure secured to a second base layer on the dorsal side of the phalangeal pocket, the intermediate phalange protective structure configured to cover at least a portion of an intermediate phalange or at least a portion of a proximal phalange of a user, wherein the first base layer and the second base layer on each phalangeal pocket are separated by a portion of the at least fabric.

11. The glove of claim 7, further comprising a lateral protective structure configured to protect a knuckle area of the user, the lateral protective structure extending laterally along the body portion on the dorsal side of the shell.

12. The glove of claim 11, further comprising a plurality of body protective structures on the dorsal side of the glove, wherein the plurality of body protective structures are secured to a body base layer featured on the body portion of the glove, and wherein the plurality of body protective structures are configured to extend across and protect metacarpal bones of a user.

13. The glove of claim 11, further comprising a plurality of body protective structures on the dorsal side of the glove configured to extend across and protect metacarpal bones of a user, wherein at least one of the plurality of body protective structures is secured to a first body base layer featured on the body portion of the glove, and another of the plurality of body protective structures is secured to a second body base layer featured on the body portion of the glove, and wherein the first and second body base layers are separated by a portion of the at least one fabric.

14. The glove of claim 7, further comprising a plurality of gripping members on the palm side of the glove.

15. The glove of claim 14, wherein the shell further comprises an elongated wrist portion, the elongated wrist portion featuring at least one wrist protective structure on the palm side of the glove.

16. The glove of claim 7, wherein the plurality of protective structures is formed of thermoplastic rubber.

17. A glove comprising:

at least one fabric forming a shell in the shape of a hand, the shell having a body portion and five pockets configured to receive a thumb and four phalanges of a user, and wherein the shell has a palm side and a dorsal side opposite the palm side; and a plurality of protective structures on the dorsal side of the at least one fabric, the plurality of dorsal structures including:

on the thumb pocket, at least one protective structure secured to a first base layer, and at least one additional protective structure secured to a second base layer, the first and second base layers on the thumb pocket being separated by a portion of the at least one fabric, on a first phalangeal pocket, at least one protective structure secured to a first base layer, and at least one additional protective structure secured to a second base layer, the first and second base layers on the first phalangeal pocket being separated by a portion of the at least one fabric, on a second phalangeal pocket, at least one protective structure secured to a first base layer, and at least one additional protective structure secured to a second base layer, the first and second base layers on the second phalangeal pocket being separated by a portion of the at least one fabric, on a third phalangeal pocket, at least one protective structure secured to a first base layer, and at least one additional protective structure secured to a second base layer, the first and second base layers on the third phalangeal pocket being separated by a portion of the at least one fabric, on a fourth phalangeal pocket, at least one protective structure secured to a first base layer, and at least one additional protective structure secured to a second base layer, the first and second base layers on the fourth phalangeal pocket being separated by a portion of the at least one fabric, a lateral protective structure, the lateral protective structure configured to protect a knuckle area of the user, wherein the lateral protective structure is secured to a common base layer on the body portion of the glove, the common base layer extending in the direction of the four phalange pockets to connect the second base layer of each of the first, second, third, and fourth phalangeal pockets, and a set of body protective structures, the set of body protective structures configured to protect metacarpal bones of a user, wherein the set of body protective structures is secured to a body base layer on the body portion of the glove.

18. The glove of claim 17, wherein the second base layer on each of the thumb pocket, the first phalangeal pocket, the second phalangeal pocket, the third phalangeal pocket, and the fourth phalangeal pocket supports multiple protective structures on each respective second base layer, and wherein the multiple protective structures on each respective second base layer are configured to cover at least a portion of intermediate phalanges of the user.

19. The glove of claim 17, wherein each of the protective structures on the thumb pocket, the first phalangeal pocket, the second phalangeal pocket, the third phalangeal pocket, and the fourth phalangeal pocket is divided approximately in half in a longitudinal direction, creating a plurality of protective substructures.

20. The glove of claim 17, further comprising a plurality of gripping members on the palm side of the glove.

21. The glove of claim 17, wherein the shell further comprises an elongated wrist portion, the elongated wrist portion featuring at least one wrist protective structure on the palm side of the glove.

22. The glove of claim 17, wherein the plurality of protective structures is formed of thermoplastic rubber.

* * * * *